United States Patent [19]

Shimofuri

[11] Patent Number: 4,495,747

[45] Date of Patent: Jan. 29, 1985

[54] METHOD AND APPARATUS FOR AUTOMATICALLY PREPARING FLEXIBLE, DISPOSABLE PACKING CONTAINERS

[75] Inventor: Koichi Shimofuri, Kyoto, Japan

[73] Assignee: Todo Seisakusho Ltd., Japan

[21] Appl. No.: 340,354

[22] Filed: Jan. 18, 1982

[51] Int. Cl.[3] ..... B65B 61/18

[52] U.S. Cl. ..... 53/412; 53/133; 53/436; 53/528; 493/465

[58] Field of Search ..... 53/133, 135, 399, 412, 53/528, 588, 589, 436; 100/1, 3, 17, 18, 19 R, 20; 493/177, 465

[56] References Cited

U.S. PATENT DOCUMENTS

| | | | |
|---|---|---|---|
| 705,134 | 7/1902 | Pope et al. | 100/3 |
| 1,190,848 | 7/1916 | Batdorf | 53/528 |
| 2,982,063 | 5/1961 | Coleman et al. | 100/1 X |
| 3,568,591 | 3/1971 | Dunlap | 100/17 X |
| 4,111,116 | 9/1978 | Ito et al. | 53/586 X |
| 4,187,773 | 2/1980 | Sampson | 100/19 R X |

*Primary Examiner*—Robert L. Spruill
*Assistant Examiner*—Steven P. Weihrouch
*Attorney, Agent, or Firm*—Ostrolenk, Faber, Gerb & Soffen

[57] ABSTRACT

In automatic preparation of flexible, disposable packing containers for materials such as eggs or fruits during intermittent transportation along a straight path of travel of each packing container, an opener cord is wound up and tied about the joint between receptacle and cover of the packing container while provisionally deforming, making use of the flexibility, the packing container so that the joint should assume an arcuate construction, and removal of deformation brings about tight winding-up of the joint so that pulling of the cord in a sealed packing container by users should enable easy opening of the packing container through breakage of the joint.

12 Claims, 6 Drawing Figures

METHOD AND APPARATUS FOR AUTOMATICALLY PREPARING FLEXIBLE, DISPOSABLE PACKING CONTAINERS

BACKGROUND OF THE INVENTION

The present invention relates to method and apparatus for automatically preparing flexible, disposable packing containers, and more specifically relates to a fully automatic system for winding up an opener cord tightly about the joint between a receptacle and a cover of each packing container which is made of a plastic film and used for encasing together a number of articles such as eggs or fruits.

A packing container of this type in general has a flat box type construction made up of a receptacle and a cover coupled together along an elongated straight joint, and is made from a thermoplastic material such as hard polyvinyl chloride film by vacuum moulding.

After the articles have been placed in the receptacle, the cover is folded over the receptacle along the joint and, conventionally, mating brims of the receptacle and the cover are sealed together by thermal fusion or thermal pressing. In order to open the packing container, it is therefore necessary to break or separate the packing container along the sealed brims and this operation often causes undesirable breakage or damage of the article contained inside.

In order to avoid this problem, a new type of packing container has already been proposed. This new type packing container includes an opener cord tightly winding up the joint between the cover and receptacle of the packing container. For use, the section of the opener cord exposed outside the joint is pulled hard and strongly in order to break the packing container along the joint.

Conventionally preparation of packing containers has been carried out by manual operation. That is, an opener cord in a stretched state has to be wound up and tied by hand about the joint of each packing container. This operation is very time consuming and causes pain on the fingers of the operators. The operation further requires that the operators be skilled. As a result of these factors, it is almost infeasible to prepare packing containers of the foregoing type to meet enlarged consumption of articles on market.

SUMMARY OF THE INVENTION

It is an object of the present invention to provide a fully automatic system for preparation of flexible disposable packing containers with opener cords.

It is another object of the present invention to meet increased demand for flexible disposable packing containers with opener cords inevitably caused by enlarged consumption of food or other articles.

In accordance with the basic concept of the present invention, packing containers made of a flexible material are transported one after another along a path of travel defined by a straight run of an endless carrier chain driven for intermittent circulation. The joint between the cover and receptacle of each packing container is directed in the direction path of travel. An opener cord delivered from a given supply source is wound up and tied about the joint of each packing container while causing, making use of the flexibility of the container, provisional elastic deformation of the packing container by cooperation of a holder on the endless chain and preferably a rotary stopper so that the joint should assume an arcuate configuration, and the deformation is thereafter removed.

DESCRIPTION OF THE PREFERRED EMBODIMENT

Figure 1:
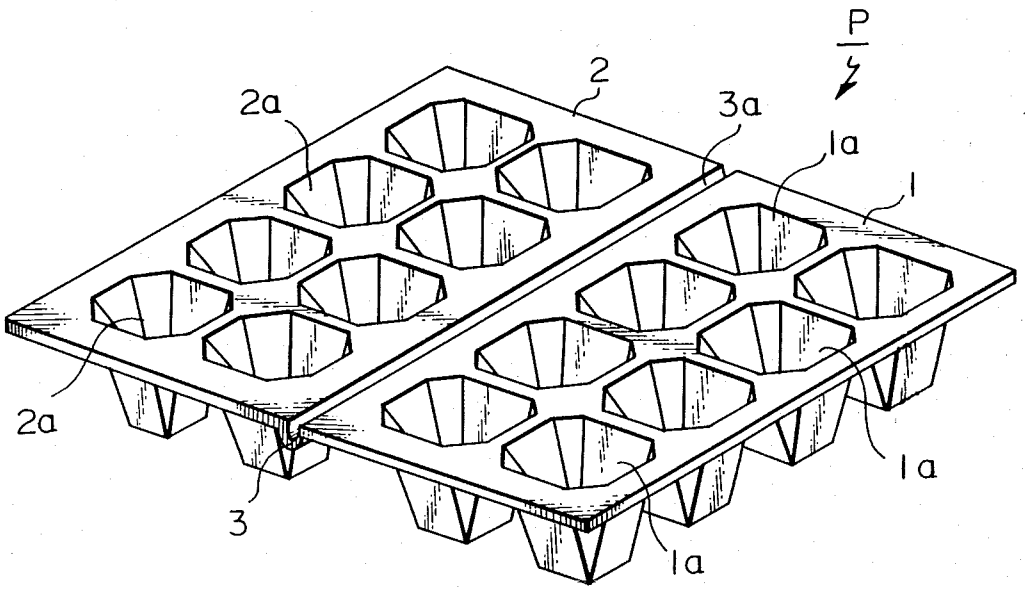
FIG. 1 is a perspective view of a flexible, desposable packing container for which an opener cord is used.
Figure 2:
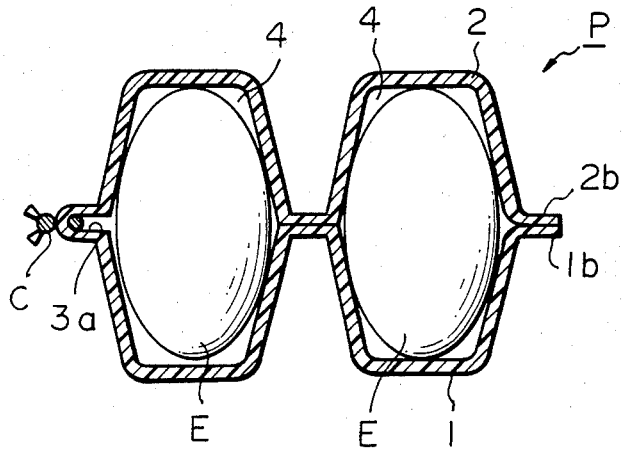
FIG. 2 is a cross sectional view of the packing container shown in FIG. 1 after the container has been closed.

One typical example of the disposable packing container to be prepared in accordance with the present invention is shown in FIGS. 1 and 2, in which the container is used for packing eggs. The packing container P is made of a thermoplastic film and includes a receptacle 1 and a cover 2 coupled in one body along an elongated joint 3 which is provided with an elongated groove 3*a* for accommodating an opener cord described above. The receptacle 1 includes, in the case of the illustrated example, two parallel arrays of separate frustum depressions 1*a* for accommodating eggs, each array including four depressions 1*a*. At corrresponding positions, the cover 2 includes two parallel arrays of depressions 2*a*. When folded along the elongated joint 3, mating depressions 1*a* and 2*a* form cavities 4 for accommodating eggs E as shown in FIG. 2. In this folded state, an opener cord C is tightly wound up around the joint in such a manner that one longitudinal section of the opener cord C is placed in the groove 3*a* at the joint 3 and the other longitudinal section runs along the outside projection of the joint 3. Mating brims 1*b* and 2*b* of the receptacle 1 and the cover 2 are sealed together by a suitable process such as thermal fusion and bonding tape application.

In order to open the packing container, the outer section of the opener cord C is pulled outwards by hand, thereby breaking the packing container along the elongated joint 3.

Figure 3:
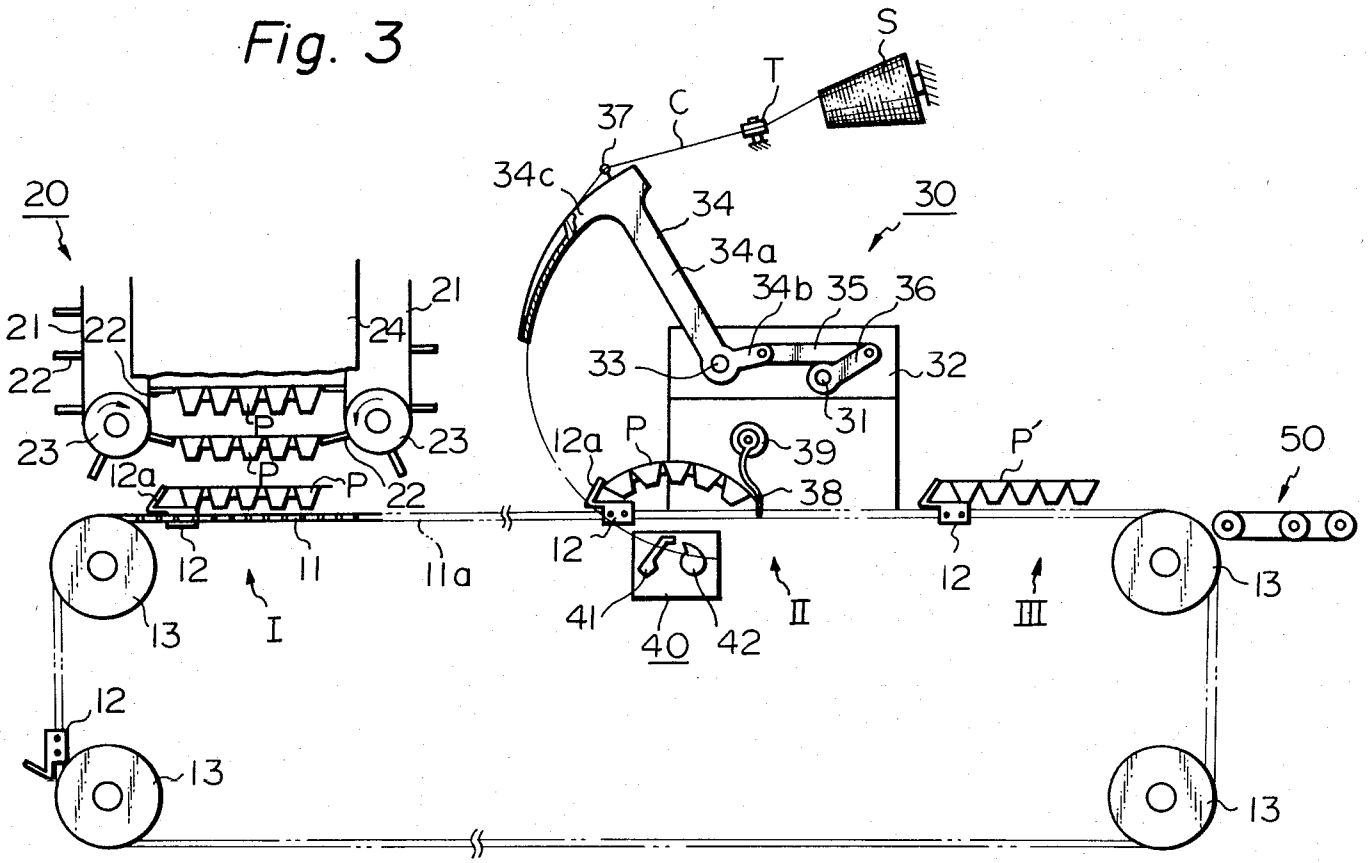
FIG. 3 is a side view of one embodiment of the apparatus in accordance with the present invention.

One embodiment of the apparatus in accordance with the present invention is shown in FIG. 3, in which the apparatus is used for automatically preparing packing containers each with five depressions per array.

The apparatus includes a carrier chain 11 driven for intermittent movement by sprocket wheels 13 operationally coupled to a suitable known driving source (not shown) and the carrier chain 11 includes a horizontal upper run 11*a* over the pedestal (not shown) of the apparatus. For simplification, most of the carrier chain 11 is shown with fantom lines in the illustration. A plurality of holders 12 are secured at equal intervals to the carrier chain 11 and each adapted for holding a packing container P in a substantially horizontal state. Only four holders 12 are shown in the illustration for simplification purposes. Each holder 12 is provided with a raised section 12*a* extending an acute angle with the path of travel of the carrier chain 11 in order to abut the trailing end of each packing container P.

Three operational stations I, II and III are located along the path of travel of the carrier chain 11. The first station I is for supply of packing containers P to the system, the second station II is for the intended preparation of the packing containers P, and the third station III is for removal of the packing container from the system. The intermittent movement of the carrier chain 11 is adjusted so that one packing container should be located at each station during the dwell time of the intermittent movement of the chain 11.

A suitable supply assembly 20 is located at the first station in order to supply a single packing container P to the holder 12 located at station I each time the chain 11 stops. In the case of the illustrated embodiment, a gravity type supply assembly 20 is employed. The supply assembly 20 is located above the carrier chain 11 and includes a pair of vertical belts 21 spaced apart in the direction of the path of travel of the carrier chain 11 over a distance somewhat larger than the length of the joint 3 of each packing container P (see FIG. 1). Each belt 21 is provided, at equal intervals on its outer surface, with a plurality of holder pegs 22 which releasably engage the longitudinal brims of the packing containers P. The belts 21 are driven for intermittent circulation by a pair of pulleys 23 in synchronism with the circulation of the carrier chain 11. As the pulleys 22 rotate in the direction indicated by arrows, corresponding holder pegs 22 on the inside sections of the belts 21 move downwards with a packing container P in a substantially horizontal state within a chute 24 and, at a location near the lower end of the chute 24, release the support to the packing container P by their movement around the pulleys 23 so that the packing container P falls on a holder 12 in the first station I under the force of gravity.

The supply assembly may take other forms too. In one example, a plurality of packing containers are stacked over the first section I in a mutually nested horizontal orientation so that they can be separated, by application of pneumatic suction, one by one from the stack onto the holder 12 in the first section. Any separating means other than the pneumatic suction may also be employable.

An opener cord winding-up assembly 30 is arranged at the second station II. This assembly 30 is adapted to wind up an opener cord C around the joint 3 of each packing container P arriving at the second station II. A drive shaft 31 is rotatably and horizontally supported by a stand 32 secured atop the pedestal of the apparatus. This drive shaft 31 is driven by a suitable known mechanism (not shown) for intermittent 360° rotation. A pin 33, which is oriented parallel to drive shaft 31, is secured to the stand 32 and a cord guide 34 is pivotally connected at its apex to the pin 33. Cord guide 34 extends in the direction of the path of travel of the carrier chain 11 and is made up of three sections, i.e. an upper arm **34*a*, a lower arm 34*b* formed in one body with the upper arm 34*a* and an arcuate nose 34*c* formed at the upper end of the upper arm 34*a*. The lower arm 34*b* of the cord guide 34 is operationally coupled to the drive shaft 31 by means of bell crank elements 35 and 36. A guide eye 37 is fixed atop the arcuate nose 34*c* of the cord guide 34 so that an opener cord C is delivered from a given supply source S to the cord guide 34 via a suitable tension element T fixed to the framework of the apparatus. As the drive shaft 31 rotates, the arcuate note 34*c* of the cord guide 34** moves along a circular locus shown with a chain line in the illustration.

A pivoting stopper 38 is arranged below the cord guide 34 and is driven to pivot by a solenoid 39 attached to the stand 32 in such a manner as to come into engagement with the leading edge of a packing container P located at the second station II. The position of the stopper 38 is chosen so that, when it is in engagement with the leading edge of the packing container P held by the holder 12 registered at the second station II, the packing container P is provisionally elastically deformed into an upwardly convex configuration while being clamped between the raised section **12*a* of the holder 12 and the stopper 38** in the lower position.

A knotter assembly 40 is located below the horizontal upper run **11*a* of the carrier chain 11 in the second station II. This knotter assembly 40 is of a known type and includes knotting and clipping elements 41 and 42 arranged in the circular locus of the cord guide 34**.

Although not shown in the illustration, the third station is accompanied with a suitable removal assembly for prepared packing containers P′ each having an opener cord wound up about its joint 3. One example of such an assembly may take a construction substantially same as the supply assembly 20 but operating in the reverse manner. Alternatively, a suitable lifter may be arranged below the third station and periodically push up the prepared packing containers P′ in order to form a nested stack above the third station. As a further alternative, a belt conveyer 50 may be arranged, as shown in the illustration, next to the downstream terminal of the horizontal upper run **11*a* of the carrier chain 11 in order to receive the prepared packing containers P′ thrown off the holder 12**.

Figure 5:
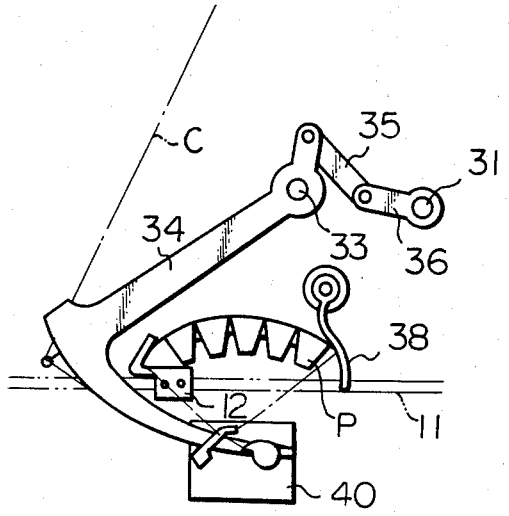
Figure 6:
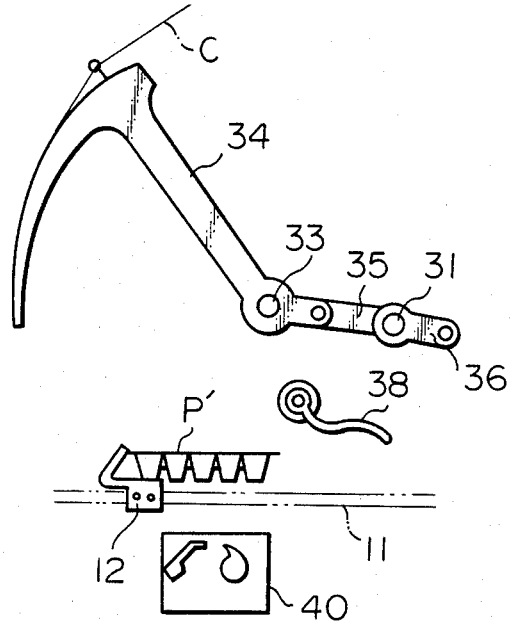

The opener cord winding-up assembly 30 arranged at the second operational station II operates in the following manner, reference being made to FIGS. 4 to 6.

The operation starts with the situation in which the opener cord C from the supply source S runs to the knotter assembly 40 via the cord guide 34 of the winding up assembly 30. Now, with advancing movement of the carrrier chain 11, a packing container P is brought to the second station II by an associated holder 12 and the section of the opener cord C extending between the cord guide 34 and the knotter assembly 40 is caught by the leading edge of the advancing packing container P. Under this condition, the packing container P abuts the elongated stopper 38 registered at a low position and is forced to assume an upwardly convex configuration. This provisional elastic deformation of the packing container P is allowed due to the flexible nature of the material and forms the heart of the present invention. The cord C is pulled by the leading edge of the packing container P and delivered from the supply source S in order to assume a course shown in FIG. 4. That is, the section Ca of the cord C between the cord guide 34 and the leading edge of the packing container is now located facing the joint 3 of the packing container P.

Figure 4:
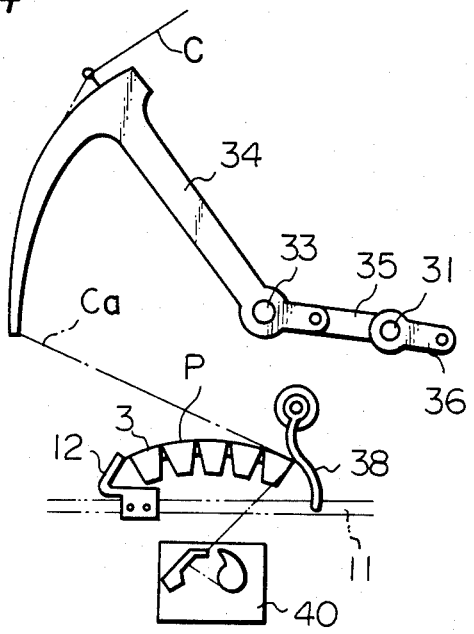
FIGS. 4 to 6 are side views for showing the sequential operation of the apparatus shown in FIG. 3.

Next, the drive shaft 31 is rotated 360° in the counterclockwise direction as viewed in FIG. 4.

By the first half revolution of the drive shaft 31, the cord guide 34 is driven for counterclockwise rotation via the bell crank elements 35 and 36 in order to assume a low position shown in FIG. 5 below the path of travel of the carrier chain 11. In this situation, the above-described section Ca of the opener cord C extends partly along the joint 3 of the packing container P and partly between the point of the arcuate nose **34*c* of the cord guide 34 and the trailing edge of the packing container P across the knotter assembly 40. Since the leading end of the opener cord C has already been caught in the knotter assembly 40, the joint 3** of the packing container P is now surrounded by the opener cord C.

Knotting of the opener cord C is carried out under this condition by the combined operation of the knotting and clipping elements 41 and 42 of the knotter assembly 40. Thus an endless ring is formed around the joint 3 of the packing container P.

By the next half revolution of the drive shaft 31 the cord guide 34 is driven for clockwise return rotation via the bell crank elements 35 and 36 in order to resume the initial high position shown in FIG. 3. Concurrently with this return movement of the cord guide 34, the stopper 38 is turned upwards by the solenoid 39 to a high position shown in FIG. 6 in order to remove the hold on the packing container P. Then, the packing container P immediately resumes its normal straight configuration due to its own resiliency so that the endless ring of the opener cord C around the joint 3 of the packing container P is stretched in order to tightly wind up the joint 3. This automatic resumption of the initial configuration also forms the heart of the present invention.

Subsequent intermittent movement of the carrier chain 11 brings the prepared packing container P′ on the associated holder 12 to the third station III for removal from the system. The stopper 38 is then returned to the initial low position shown in FIG. 4 for engagement with the next packing container P.

By cyclically repeating the above-described operation, the packing containers P supplied to the system at the first station I are subsequently wound up at their joints at the second station II and removed from the system at the third station III. As such the present invention enables highly efficient automatic preparation of disposable packing containers by making use of their resilient nature. Further, since the opener cord is tightly applied to the joints of the packing containers, later handling of the packing containers are quite free of tangling and hooking troubles.

I claim:

1. A method for providing a flexible container of the type which includes a receptacle section and a cover section connected to one another by a substantially straight elongated joint with an opener cord surrounding said joint, said method comprising the steps of:

bending said flexible container along said joint in such a manner that said joint is bent into an arc as viewed in a plane which passes through the entire length of said joint;

placing an opener cord around said joint while it is bent into said arc, the length of said cord being approximately twice the length of said joint; and, thereafter, permitting said container to assume its original shape.

2. A method as claimed in claim 1, wherein said flexible container is initially placed in a generally horizontal orientation and is then bent into an upwardly convex arcuate configuration during said bending step.

3. A method as claimed in claim 1 or 2, wherein said bending step is carried out by applying oppositely directed forces to respective opposite edges of said packing container.

4. A method for automatically preparing flexible, disposable packing containers of the type which includes a receptacle section and a cover section connected to one another by a substantially straight elongated joint, and an opener cord surrounding said joint, said method comprising the steps of:

(A) intermittently supplying flexible containers, each of which has a cover section and receptacle section connected together by a substantially straight joint, one at a time, to a first operation station with said joint extending in a first direction;

(B) advancing each said packing container after it has been placed at said first station along a path of travel which runs parallel to said first direction to a second operation station while maintaining the orientation of said joint in said first direction;

(C) carrying out an opening cord tying operation on each said container located at said second station, said tying operation including the steps of:

(1) applying oppositely directed forces to first and second opposite ends, respectively, of each said container located at said second operation station, said oppositely directed forces being applied along said first direction, in order to cause elastic deformation of the said container located at said second station into an arcuate configuration whereby its said joint is bent into an arc as viewed along a plane running through said first direction;

(2) guiding an opener cord from a supply source fully around said joint of the said container located at said second station and bent into said arcuate configuration;

(3) knotting together ends of said opener cord after it extends fully around said joint of said container located at said second station; and (4) removing said oppositely directed forces applied to the said container located at said second station thereby allowing the said container to resume its unbent configuration; and (D) advancing each said packing container from said second station after said cord tying operation for that said container has been completed to a third operation station for removal of said packing containers from said path of travel, said steps being all carried out in an automatic fashion.

5. A method as claimed in claim 4, in which said path of travel of said packing containers extends substantially horizontally, and each said packing container is deformed into an upwardly convex arcuate configuration.

6. Apparatus for automatically preparing flexible, disposable packing containers of the type which includes a receptacle section and a cover section connected to one another by a substantially straight elongated joint, and an opener cord surrounding said joint, said apparatus comprising:

(A) means for intermittently and sequentially supplying flexible containers, each of which has a cover section and a receptacle section connected together by a substantially straight joint, one at a time, to a first operation station with said joint extending in a first direction;

(B) means for advancing each said packing container after it has been placed at said first station along a path of travel which runs parallel to said first direction to a second operation station, maintaining said packing container at said second operation station during a cord tying operation and thereafter advancing said packing container to a third operation station at which said packing containers may be removed from said path of travel, said advancing means advancing each said packing container from said first, to said second operating station while maintaining the orientation of said joint in said first direction;

(C) means for carrying out an opener cord tying operation on each said container located at said second station, said tying operation including the steps of:

(1) applying oppositely directed forces to respective opposite ends of each said container located at said second operation station, said oppositely directed forces being applied along said first direction, in order to cause elastic deformation of the said container located at said second station into an arcuate configuration whereby its said joint is bent into an arc as viewed along a plane running through said first direction;

(2) guiding an opener cord from a supply source fully around said joint of the said container located at said second station and bent into said arcuate configuration;

(3) knotting together ends of said opener cord after it extends fully around said joint of said container located at said second station; and (4) removing said oppositely directed forces applied to the said container located at said second station thereby allowing the said container to resume its unbent configuration; and (D) means for removing each said packing container from said third station after it reaches said third station.

7. An apparatus as claimed in claim 6, wherein said advancing means includes an endless chain carrier including at least one straight run which defines said path of travel for said packing containers and means for driving said chain carrier for intermittent circulation such that one of said packing container is located at each of said first, second and third operating stations during each dwell of said intermittent circulation.

8. Apparatus as claimed in claim 7, in which said straight run of said chain carrier is a substantially horizontal run, and the said packing container located at said second station is bent into an upwardly convex configuration.

9. Apparatus as claimed in claim 8, further including holders fixed to said chain carrier at equally spaced intervals, each of said holders being adapted to hold a packing container abutting said holder in a straight state in the direction of said path of travel and wherein said means for carrying out an opener cord tying operation includes an elongated stopper and the solenoid for moving said elongated stopper between an upper and a lower position, the horizontal distance between said elongated stopper and said lower position and each said holder located at said second operation station being smaller than the length of said joint of each said packing container when said packing container is in said unbent configuration.

10. Apparatus as claimed in claim 9, wherein said means for carrying out an opener cord tying operation includes means for applying said oppositely directed forces to respective opposite ends of each said container located at said second operation station;

means for guiding said opener cord from a supply source fully around said joint of said container located at said second station and bent into said arcuate configuration; and means for knotting together each said opener cord after it extends fully around said joint of said container located at said second station.

11. Apparatus as claimed in claim 10, wherein said means for knotting comprises a knotter assembly arranged beneath said horizontal one of said carrier chains.

12. Apparatus as claimed in claim 11, in which said means for guiding an opener cord includes a cord guide pivoted to a horizontal pin and having an arcuate nose extending in a vertical plane including said path of travel, and means for rotating said cord guide about said horizontal pin so that said arcuate nose brings one end of said opener cord to said knotter assembly.

* * * * *